US009745751B2

(12) United States Patent
Zaghi et al.

(10) Patent No.: US 9,745,751 B2
(45) Date of Patent: Aug. 29, 2017

(54) REINFORCED STRUCTURAL COLUMN SYSTEM

(71) Applicant: University of Connecticut, Farmington, CT (US)

(72) Inventors: Arash Esmaili Zaghi, Mansfield, CT (US); Alicia Anisita Echevarria, Jersey City, NJ (US)

(73) Assignee: University of Connecticut, Farmington, CT (US)

( * ) Notice: Subject to any disclaimer, the term of this patent is extended or adjusted under 35 U.S.C. 154(b) by 0 days.

(21) Appl. No.: 14/770,480

(22) PCT Filed: Feb. 26, 2014

(86) PCT No.: PCT/US2014/018615

§ 371 (c)(1),
(2) Date: Aug. 26, 2015

(87) PCT Pub. No.: WO2014/134136

PCT Pub. Date: Sep. 4, 2014

(65) Prior Publication Data

US 2016/0002927 A1 Jan. 7, 2016

Related U.S. Application Data

(60) Provisional application No. 61/769,642, filed on Feb. 26, 2013.

(51) Int. Cl.
*E04C 3/34* (2006.01)
*E04C 5/07* (2006.01)
(Continued)

(52) U.S. Cl.
CPC ..... *E04C 3/34* (2013.01); *E04B 1/19* (2013.01); *E04B 1/30* (2013.01); *E04C 5/012* (2013.01); *E04C 5/073* (2013.01); *E04C 5/07* (2013.01)

(58) Field of Classification Search
CPC ... E04C 3/35; E04C 5/07; E04C 5/073; E04C 5/012; E04B 1/19; E04B 1/30
See application file for complete search history.

(56) References Cited

U.S. PATENT DOCUMENTS 3,123,102 A * 3/1964 Frieder ..... F16L 57/04 138/125
3,231,341 A * 1/1966 Sump ..... B29C 70/12 248/346.01

(Continued)

FOREIGN PATENT DOCUMENTS

EP 1624137 A1 2/2006
EP 2543499 A1 1/2013

(Continued)

OTHER PUBLICATIONS

PCT International Search Report and Written Opinion for PCT/US2014/018615 dated Jun. 13, 2014.

(Continued)

*Primary Examiner* — Jeanette E Chapman
(74) *Attorney, Agent, or Firm* — McCarter & English, LLP

(57) ABSTRACT

Improved structural column assemblies and related fabrication methods are provided. More particularly, the present disclosure provides improved systems/methods for the design and fabrication of structural column assemblies having improved mechanical properties and/or improved resistance to multiple hazards (e.g., earthquakes, blasts, high temperatures, etc.). Disclosed herein is a structural column assembly having a uniquely designed fiber reinforced polymer (FRP) tube filled with concrete to be used as a structural column (e.g., in bridge and/or building construction). The exemplary composite or FRP tube can include layers of metallic and/or non-metallic fibers wound at improved/optimized angles. A multi-hazard resilient column system (Continued)

which can negate the need for additional concrete reinforcement or formwork at construction sites is provided. The novel tube is highly resistant to corrosive environments, and will facilitate accelerated bridge construction (ABC), while providing a solution for columns at risk from multiple hazards.

15 Claims, 5 Drawing Sheets

(51) Int. Cl.

| | |
|---|---|
| ***E04B 1/19*** | (2006.01) |
| ***E04B 1/30*** | (2006.01) |
| ***E04C 5/01*** | (2006.01) |

(56) References Cited

U.S. PATENT DOCUMENTS

| | | | | |
|---|---|---|---|---|
| 3,520,749 | A * | 7/1970 | Rubenstein | B28B 23/046 138/175 |
| 5,218,810 | A | 6/1993 | Isley | |
| 5,296,187 | A * | 3/1994 | Hackman | B28B 1/523 264/257 |
| 5,599,599 | A * | 2/1997 | Mirmiran | B29C 70/865 428/120 |
| 6,189,286 | B1 * | 2/2001 | Seible | E04C 3/20 52/834 |
| 6,247,279 | B1 * | 6/2001 | Murat | E04C 3/34 52/223.13 |
| 7,682,993 | B2 | 3/2010 | Derrigan et al. | |
| 7,824,751 | B2 | 11/2010 | Lockwood et al. | |
| 2006/0070338 | A1 * | 4/2006 | Pantelides | E04C 3/34 52/847 |
| 2013/0152490 | A1 * | 6/2013 | Hinchman | E04H 9/02 52/167.3 |
| 2013/0316104 | A1 * | 11/2013 | Adam | B28B 13/021 428/34.5 |

FOREIGN PATENT DOCUMENTS

| | | |
|---|---|---|
| JP | 2010084328 A | 4/2010 |
| WO | WO95/23898 | 9/1995 |

OTHER PUBLICATIONS

Serial No. PCT/US2014/018615, Filing Date Feb. 26, 2014, Publication No. / Patent No. WO 2014/134136 A1.

* cited by examiner

REINFORCED STRUCTURAL COLUMN SYSTEM

CROSS-REFERENCE TO RELATED APPLICATIONS

This application claims the benefit of U.S. Provisional Application No. 61/769,642 filed Feb. 26, 2013, all of which is herein incorporated by reference in its entirety.

BACKGROUND

1. Technical Field

The present disclosure relates to systems and methods for the design and fabrication of structural column assemblies and, more particularly to the design and fabrication of structural column assemblies having improved mechanical properties and/or increased durability and/or improved resistance to multiple hazards (e.g., earthquakes, blasts, high temperatures, etc.).

2. Background Art

In general, conventional reinforced concrete (RC) columns include heavy steel rebar cages, which are either assembled at the construction site or prefabricated and shipped to the site and placed in the column form prior to casting the wet concrete. These rebar cages typically include a large number of longitudinal bars for flexural and compressive resistance, and either a continuous spiral or a number of hoops that serve as transverse reinforcement and provide shear resistance to the columns and confinement to the concrete core to enhance the post-yield load carrying capacity of a structural column. The use of conventional RC columns requires large amounts of material, labor, and time to complete construction. Concrete forms must be used during casting and removed after the concrete has cured, and in most cases, scaffolding is required at the construction site to complete fabrication of the reinforcement cages and placement of the concrete.

Some exemplary assemblies/systems in this general field are described and disclosed in U.S. Pat. Nos. 7,824,751; 6,189,286; 5,599,599; 5,218,810; and 7,682,993, and EP1, 624,137 and WO95/23898, the entire contents of each being hereby incorporated by reference in their entireties.

In general, a constant need exists among manufacturers to develop structural column assemblies or the like that are cost-effective and/or include improved features/structures.

Thus, an interest exists for improved structural column assemblies and related fabrication methods. These and other inefficiencies and opportunities for improvement are addressed and/or overcome by the assemblies, systems and methods of the present disclosure.

SUMMARY

The present disclosure provides advantageous structural column assemblies, and improved methods/systems for fabricating/using the same. The present disclosure provides advantageous systems/methods for the design and fabrication of structural column assemblies. More particularly, the present disclosure provides improved systems/methods for the design and fabrication of structural column assemblies having improved mechanical properties and/or improved resistance to multiple hazards (e.g., earthquakes, blasts, high temperatures, etc.).

In exemplary embodiments, disclosed herein is a structural column assembly/system having a uniquely designed fiber reinforced polymer (FRP) tube filled with concrete (e.g., conventional and/or high-strength concrete) to be used as a structural column (e.g., in bridge and/or building construction). In general, the composite or FRP tube can include layers of metallic fibers/strips and/or non-metallic fibers wound at improved or optimized angles, and the fire resistance of the tube can be enhanced through the use of heat resistant resins and/or a fire protection cover/layer. The present disclosure provides a multi-hazard resilient column system which can negate the need for additional concrete reinforcement or formwork at construction sites. The innovative tube is highly resistant to corrosive environments and will facilitate accelerated bridge construction (ABC), while providing a solution for columns at risk from multiple hazards (e.g., seismic, blast, fire exposure, etc.).

Disclosed herein are systems/methods for designing and using a concrete-filled composite tube as a structural column system. In exemplary embodiments, the fiber reinforced polymer (FRP) hollow shell includes both non-metallic fibers and metallic fibers/strips, and the hollow shell: (i) is filled with and/or surrounds/houses concrete (e.g., unreinforced concrete), and (ii) can be made more resilient to fire through use of heat resistant resins and/or a fire protection cover/layer that is added as a layer of the concrete filled shell.

The exemplary column assemblies/systems can advantageously eliminate the need for steel reinforcement inside the concrete. The composite tube may be pre-fabricated and/or can be offered for sale off-the-shelf. As disclosed herein, the exemplary structural column assemblies can provide engineers with both a pre-cast and cast-in-place option for desired projects, and can eliminate the use of scaffolding and/or formwork for column construction.

It is an object of the present disclosure to provide cost-effective, multi-hazard resilient structural systems/assemblies. It is a further object to provide cost-effective systems/assemblies for accelerated bridge construction (ABC) or the like.

The present disclosure provides for a structural column assembly including a concrete core having an outer surface, the concrete core containing no metallic reinforcing material; and a reinforced polymer shell that includes a polymeric material, non-metallic fibers and metallic fibers or strips, the reinforced polymer shell positioned around the outer surface of the concrete core.

The present disclosure also provides for a structural column assembly wherein the reinforced polymer shell is substantially circular. The present disclosure also provides for a structural column assembly wherein the polymeric material includes heat resistant resin. The present disclosure also provides for a structural column assembly wherein the non-metallic fibers are selected from the group consisting of glass, carbon, aramid, aromatic polyamide, and para-aramid fibers, and combinations thereof.

The present disclosure also provides for a structural column assembly wherein the metallic fibers or strips are selected from the group consisting of mild steel, high strength steel, super-elastic metallic alloy, and shape memory metallic alloy fibers or strips, and combinations thereof.

The present disclosure also provides for a structural column assembly wherein the non-metallic fibers and the metallic fibers or strips are embedded in the polymeric material. The present disclosure also provides for a structural column assembly wherein the reinforced polymer shell includes an outer surface; and further comprising a layer of fire protective material positioned around the outer surface of the reinforced polymer shell.

The present disclosure also provides for a structural column assembly wherein the orientation of the non-metallic fibers is selected independently from the orientation of the metallic fibers or strips. The present disclosure also provides for a structural column assembly wherein two or more reinforcements of the non-metallic fibers and metallic fibers or strips are wound within the reinforced polymer shell or are wound on the surface of the reinforced polymer shell.

The present disclosure also provides for a structural column assembly wherein two or more reinforcements of the non-metallic fibers and metallic fibers or strips are coiled within the reinforced polymer shell or are coiled on the surface of the reinforced polymer shell. The present disclosure also provides for a structural column assembly wherein two or more reinforcements of the non-metallic fibers and metallic fibers or strips are oriented in a mesh pattern within the reinforced polymer shell or are oriented in a mesh pattern on the surface of the reinforced polymer shell.

The present disclosure also provides for a structural column assembly wherein one or more reinforcement of the non-metallic fibers are wound within the reinforced polymer shell or are wound on the surface of the reinforced polymer shell; and wherein one or more reinforcement of the metallic fibers or strips are oriented in a mesh pattern within the reinforced polymer shell or are oriented in a mesh pattern on the surface of the reinforced polymer shell. The present disclosure also provides for a structural column assembly wherein the metallic fibers or strips and the non-metallic fibers are substantially continuous.

The present disclosure also provides for a method for fabricating a structural column assembly including: a) providing a hollow reinforced polymer shell, the hollow reinforced polymer shell including a polymeric material, non-metallic fibers and metallic fibers or strips; and b) providing a concrete material to the hollow portion of the reinforced polymer shell to form a concrete core within the reinforced polymer shell, the concrete core containing no metallic reinforcing material.

The present disclosure also provides for a method for fabricating a structural column assembly wherein the reinforced polymer shell includes an outer surface; and further comprising, after or before step b), the step of coating at least a portion of the outer surface of the reinforced polymer shell with a layer of fire protective material.

The present disclosure also provides for a method for fabricating a structural column assembly wherein the polymeric material includes a resin; and wherein one or more non-metallic fibers and one or more metallic fibers or strips are embedded in the polymeric material.

The present disclosure also provides for a method for fabricating a structural column assembly wherein one or more reinforcement of the non-metallic fibers are wound within the reinforced polymer shell or are wound on the surface of the reinforced polymer shell; and wherein one or more reinforcement of the metallic fibers or strips are oriented in a mesh pattern within the reinforced polymer shell or are oriented in a mesh pattern on the surface of the reinforced polymer shell.

The present disclosure also provides for a method for fabricating a structural column assembly wherein the reinforced polymer shell is substantially circular; and wherein the metallic fibers or strips and the non-metallic fibers are substantially continuous.

The present disclosure also provides for a structural column assembly including a concrete core having an outer surface, the concrete core containing no metallic reinforcing material; a reinforced polymer shell having an outer surface, the reinforced polymer shell including a polymeric material, non-metallic fibers and metallic fibers or strips, the reinforced polymer shell positioned around the outer surface of the concrete core; and a layer of fire protective material positioned around the outer surface of the reinforced polymer shell; wherein the polymeric material includes a resin; wherein one or more non-metallic fibers and one or more metallic fibers or strips are embedded in the polymeric material; wherein one or more reinforcement of the non-metallic fibers are wound within the reinforced polymer shell or are wound on the surface of the reinforced polymer shell; wherein one or more reinforcement of the metallic fibers or strips are oriented in a mesh pattern within the reinforced polymer shell or are oriented in a mesh pattern on the surface of the reinforced polymer shell; and wherein the metallic fibers or strips and the non-metallic fibers are substantially continuous.

The present disclosure also provides for a structural column assembly wherein the reinforced polymer shell is substantially circular.

Any combination or permutation of embodiments is envisioned. Additional advantageous features, functions and applications of the disclosed systems, methods and assemblies of the present disclosure will be apparent from the description which follows, particularly when read in conjunction with the appended figures. All references listed in this disclosure are hereby incorporated by reference in their entireties.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various steps, features and combinations of steps/features described below and illustrated in the figures can be arranged and organized differently to result in embodiments which are still within the scope of the present disclosure. To assist those of ordinary skill in the art in making and using the disclosed assemblies, systems and methods, reference is made to the appended figures, wherein.

DETAILED DESCRIPTION

Figure 1:
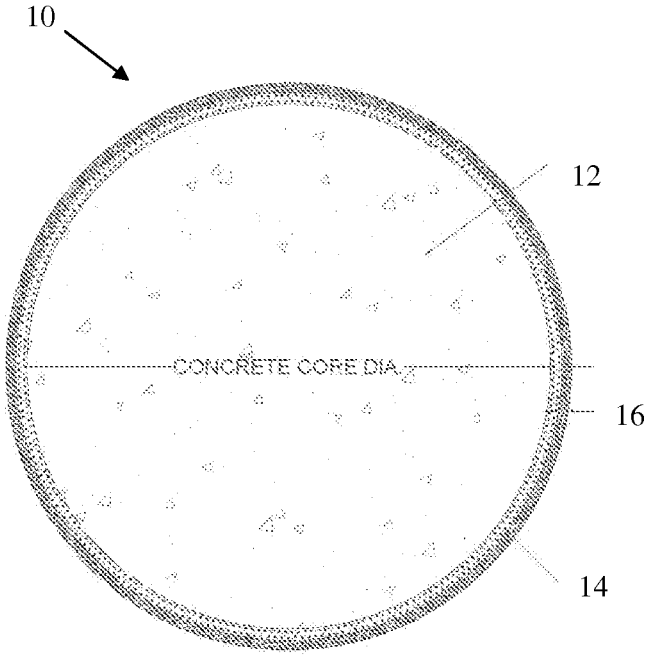
FIG. 1 is a cross-sectional view of an exemplary advanced structural column reinforcement system with a concrete core.

The exemplary embodiments disclosed herein are illustrative of advantageous structural column assemblies, and systems of the present disclosure and methods/techniques thereof. It should be understood, however, that the disclosed embodiments are merely exemplary of the present disclosure, which may be embodied in various forms. Therefore, details disclosed herein with reference to exemplary structural column assemblies/fabrication methods and associated processes/techniques of assembly and use are not to be interpreted as limiting, but merely as the basis for teaching one skilled in the art how to make and use the advantageous structural column assemblies/systems and/or alternative assemblies of the present disclosure.

In general, the present disclosure provides improved structural column assemblies and related fabrication methods. The present disclosure provides improved systems/methods for the design and fabrication of structural column assemblies. More particularly, the present disclosure provides advantageous systems/methods for the design and fabrication of structural column assemblies having improved mechanical properties and/or improved resistance to multiple hazards (e.g., earthquakes, blasts, high temperatures, etc.).

Disclosed herein is a structural column assembly/system having a uniquely designed fiber reinforced polymer (FRP) shell/tube filled with concrete to be used as a structural column assembly (e.g., in bridge and/or building construction). The exemplary composite or FRP shell/tube can include layers of metallic fibers/strips and/or non-metallic fibers wound at improved or optimized angles. The shell/tube can be protected from fire through use of heat resistant resins and/or a fire protection cover or layer. In exemplary embodiments, a multi-hazard resilient column system/assembly which can negate the need for additional concrete reinforcement or formwork at construction sites is provided. The novel tube is highly resistant to corrosive environments, and will facilitate accelerated bridge construction (ABC), while providing a solution for columns at risk from multiple hazards (e.g., seismic, blast, fire exposure, etc.).

Current practice provides that conventional reinforced concrete columns require large amounts of material, labor, and time to complete construction and in most cases, scaffolding is required at the construction site to complete fabrication of the reinforcement cages and placement of the concrete. In exemplary embodiments, the present disclosure provides for improved systems/methods for the design and fabrication of structural column assemblies having improved mechanical properties and/or improved resistance to multiple hazards (e.g., earthquakes, blasts, high temperatures, etc.), thereby providing a significant commercial, manufacturing and/or operational advantage as a result.

In general, the present disclosure provides for the design and use of a concrete-filled composite tube as a structural column system/assembly. In exemplary embodiments, the fiber reinforced polymer (FRP) hollow shell includes non-metallic fibers and/or metallic fibers/strips. In certain embodiments, the hollow shell: (i) is filled with and/or surrounds/houses concrete (e.g., un-reinforced concrete), and (ii) is manufactured using heat resistant resins and/or includes a fire protection layer or cover (e.g., has an exterior coating of fire protection that surrounds/houses the concrete filled shell).

The non-metallic fibers may be selected from, without limitation, glass, carbon, and aramid (e.g., aromatic polyamide) fibers or the like. The metallic fibers/strips may be selected from, without limitation, mild steel, high strength steel, super-elastic alloy fibers/strips, and shape memory alloy fibers/strips for added ductility and re-centering capacity.

The exemplary column assemblies/systems can advantageously eliminate the need for steel reinforcement inside the concrete. The composite tube may be pre-fabricated and/or can be offered for sale off-the-shelf. As such, the concrete-filled composite tube may be pre-fabricated. The exemplary structural column assemblies can provide engineers with both a pre-cast and cast-in place option for desired projects, and can eliminate the use of scaffolding and/or formwork for column construction.

Some benefits of the systems/assemblies of the present disclosure versus conventional practice include: (i) little or no steel reinforcement required within the concrete core of the assembly; (ii) little or no scaffolding required at construction sites; (iii) greatly reduced construction times; (iv) superb seismic, blast, and/or fire resilience and stability; and (v) high durability, corrosion resistance and long lifespan of the assembly.

Referring now to the drawings, like parts are marked throughout the specification and drawings with the same reference numerals, respectively. Drawing figures are not necessarily to scale and in certain views, parts may have been exaggerated for purposes of clarity.

Figure 2:
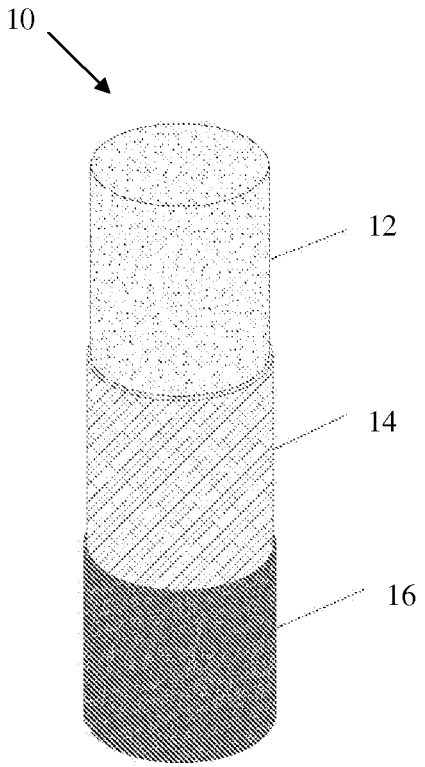
FIG. 2 is a 3-dimensional view of exemplary layers of an advanced structural column reinforcement system according to the present disclosure.

With reference to FIGS. 1-2, there is illustrated an embodiment of an exemplary structural column assembly 10 according to the present disclosure. In general, structural column assembly 10 is configured and dimensioned to be used as a structural column (e.g., in bridge and/or building construction) or the like. It is noted that structural column assembly 10 can take a variety of forms, shapes and/or designs.

In general, structural column assembly 10 includes a concrete core 12. In exemplary embodiments, concrete core 12 of structural column assembly 10 does not contain or include metallic reinforcing material within concrete core 12, although the present disclosure is not limited thereto.

In exemplary embodiments and as shown in FIGS. 1-2, the structural column assembly 10 also includes a fiber reinforced polymer (FRP) shell or tube 14. In general, FRP shell 14 includes a polymeric material (e.g., resin/layer) which may include heat resistant material, and also includes one or more non-metallic fibers and/or metallic fibers/strips in or associated with the polymeric material.

In certain embodiments, FRP shell 14 includes both non-metallic fibers and metallic fibers/strips, with the non-metallic fibers and metallic fibers/strips wound at improved/optimized angles relative to the central axis of concrete core 12.

In exemplary embodiments and also as shown in FIGS. 1-2, the FRP shell 14 can be coated, at least partially, with a layer of a fire protective material 16. A cross-sectional view of an exemplary circular column assembly 10 is shown in FIG. 1. FIG. 1 depicts the concrete core 12 encased by a shell/tube 14 fabricated from metallic fibers/strips and non-metallic fibers that are embedded in or associated with resin, which may have enhanced heat resistance, or the like. The outermost layer 16 is a variable thickness fire protection layer 16 that can be adjusted based on the desired fire rating of assembly 10. FIG. 2 displays the column assembly 10 with each layer 12, 14, 16 cut at a different height to better depict the concrete core 12, reinforcing shell/tube 14, and fire protection layer 16. The thickness and content of the reinforcing shell/tube 14 and/or fire protection layer 16 can be predetermined (e.g., based on the strength requirement and/or desired fire rating of the column system/assembly 10). The concrete core 12 may be of any suitable diameter, and the concrete grade of the concrete core 12 may be of any suitable type (e.g., based on the structural requirements of the finished column system/assembly 10).

In exemplary embodiments, the concrete core 12 extends from a first end to a second, and the FRP shell 14 substantially extends from the first end of the concrete core 12 to the second end of the concrete core 12, although the present disclosure is not limited thereto. Rather, it is noted that FRP shell 14 can extend any distance along core 12.

Likewise, FRP shell 14 extends from a first end to a second, and the exemplary fire protection layer 16 substantially extends from the first end of the FRP shell 14 to the second end of the FRP shell 14, although the present disclosure is not limited thereto. Rather, it is noted that fire protection layer 16 can extend any distance along FRP shell 14.

As noted above, the exemplary FRP shell 14: (i) is filled with and/or at least partially surrounds/houses the concrete core 12 (e.g., un-reinforced concrete core 12), and (ii) may include heat resistant resins or the like and/or has an exterior coating of fire protection 16 that at least partially surrounds/houses the concrete filled FRP shell 14.

Moreover, it is noted that the non-metallic fibers of FRP shell 14 may be selected from, without limitation, glass, carbon, and aramid (e.g., aromatic polyamide) fibers or the like. The metallic fibers/strips of FRP shell 14 may be selected from, without limitation, mild steel, high strength steel, super-elastic alloy fibers/strips, and shape memory alloy fibers/strips for added ductility and re-centering capacity.

Exemplary assembly 10 can advantageously eliminate the need for steel reinforcement inside the concrete core 12. The FRP shell 14 may be pre-fabricated and/or can be offered for sale off-the-shelf. As such, the concrete-filled FRP shell 14 (with concrete core 12) may be pre-fabricated. Exemplary assembly 10 can provide engineers with both a pre-cast and cast-in place option for desired projects, and can eliminate the use of scaffolding and/or formwork for column construction.

Some benefits of the assembly 10 versus conventional practice include: (i) little or no steel reinforcement required within the concrete core 12 of the assembly 10; (ii) little or no scaffolding required at construction sites; (iii) greatly reduced construction times; (iv) superb seismic, blast, and/or fire resilience and stability; and (v) high durability, corrosion resistance and long lifespan of the assembly 10.

In certain embodiments, assembly 10 incorporates both metallic fibers/strips and non-metallic fibers into the shell 14, although the present disclosure is not limited thereto. This can allow for the elimination of internal reinforcement within the concrete core 12 (e.g., no metallic reinforcing material within core 12). However, it is to be noted that shell 14 can include metallic fibers/strips only, or shell 14 can include non-metallic fibers only.

In certain embodiments, assembly 10 allows one to controllably design an optimal/improved orientation of the fibers within or associated with the shell 14. For example, some controllable options include, without limitation: winding fibers/reinforcements within the shell 14 and/or on the surface of the shell 14; coiling fibers/reinforcements and placing coils of fibers/reinforcements within the structure of the shell 14 and/or on the surface of the shell 14; and/or orienting fibers/reinforcements in a mesh pattern within the shell 14 and/or on the surface of the shell 14.

In an exemplary embodiment, a combination of fiber/filament winding within and/or on the surface of the shell 14, and incorporation of a steel mesh or the like within or on the surface of the shell 14 is utilized for assembly 10.

In one embodiment, a mixture of metallic fibers/strips and non-metallic fibers is used for shell 14, rather than either class of fibers alone. It is noted that metallic fibers/strips provide energy dissipation, which is a feature desired in columns which are designed to be resilient to seismic and blast forces. In some embodiments, glass and carbon fiber show little energy dissipation.

In exemplary embodiments, the fibers, whether metallic or non-metallic, are substantially continuous and thin, and have a diameter in the general range of about 0.5 μM to about 5.0 μM. In a preferred embodiment, fibers (whether metallic or non-metallic) have a diameter in the general range of about 1 μM. Some important properties of the fibers (whether metallic or non-metallic) are durability, strength, ductility, and/or re-centering capacity.

The wound fibers of the reinforcing system of shell 14 may be of a single material or a combination of metallic and non-metallic materials. Possible metallic fibers/strips include, without limitation, those including mild steel, high strength steel, super-elastic metallic alloys, and shape memory metallic alloys. Possible non-metallic fibers include, without limitation, glass, carbon, and aramid, e.g., aromatic polyamides, and para-aramids. By way of example, the U.S. Federal Trade Commission defines "aramid fiber" as "a manufactured fiber in which the fiber-forming substance is a long-chain synthetic polyamide in which at least 85% of the amide linkages, (—CO—NH—), are attached directly to two aromatic rings." It is noted that para-aramid fibers possess properties including high tenacity and high elastic modulus.

The appropriate ratio of metallic and non-metallic fibers, as well as the winding orientation, can be determined via optimization methods including use of appropriate analytical models, and may vary for different applications of the system/assembly 10. By way of example, a detailed finite element (FE) simulation/model of the column system can be performed. The FE model can be validated using the relevant data from shaking table experiments and blast tests on the concrete filled FRP tube (CFFT) or shells 14 of columns 10. The model incorporates fiber-matrix composite elements for the exterior shell and damage plasticity based on solid elements for the concrete core 12. The interaction of the core 12 and the shell 14 can be modeled using proper contact properties. The calibrated model can be used to optimize the fiber lay-up and fiber composition for improved shear resistance, confinement, longitudinal resistance, and energy dissipation capacity. Moreover, large scale specimens utilizing exemplary assemblies 10 can be subjected to seismic, blast, and fire tests to confirm the multi-hazard resilience of exemplary assemblies 10.

The finite element analysis can be optionally supplemented by parametric analysis to help further determine design parameters of the desired column assembly 10 characteristics including, without limitation: 1) influence of inner smoothness of the tube 14 on the overall performance of the composite system 10, 2) benefits of adding mild steel and super-elastic alloy fibers/strips in conjunction with non-metallic fibers to shell 14, 3) possibility of using a hollow core column to reduce the weight of the column 10 with the goal of pre-fabricating columns 10 offsite, and 4) optimum/improved embedded length of the tube 14 in the foundation of the structure to be constructed.

In some embodiments, the finite element analysis can be optionally supplemented by parametric analysis of column design to include parameters such as fiber type, fiber combinations, fiber volume for different fiber types, relative fiber orientation with respect to the vertical axis of the column 10, and the effect of end fixity of columns 10. Parameters can be evaluated under different load and bridge system parameters, and also under different damaging event scenarios.

In certain embodiments of the columns and systems 10 disclosed herein, the CFP fire protection system obtained from Fyfe Co. LLC was used as the fire protection/protective layer 16 of the advanced structural column system/assembly 10. Current practice for the use of this fire protection system is to have it applied after column construction has taken place. In certain embodiments of the columns and system 10 disclosed herein, heat resistant resins and/or a fire protection layer 16, such as the CFP system, are added to or incorporated into the reinforcing shell 14 during the manufacturing process.

The disclosed column systems/assemblies 10 can simplify the construction of concrete columns or the like. The tube 14 can be offered for sale off-the-shelf, and can be installed with minimal effort of construction companies. In exemplary embodiments, once the prefabricated tube 14 has been filled with concrete, it provides a self-curing environment, and no formwork will have to be removed.

Figure 3:
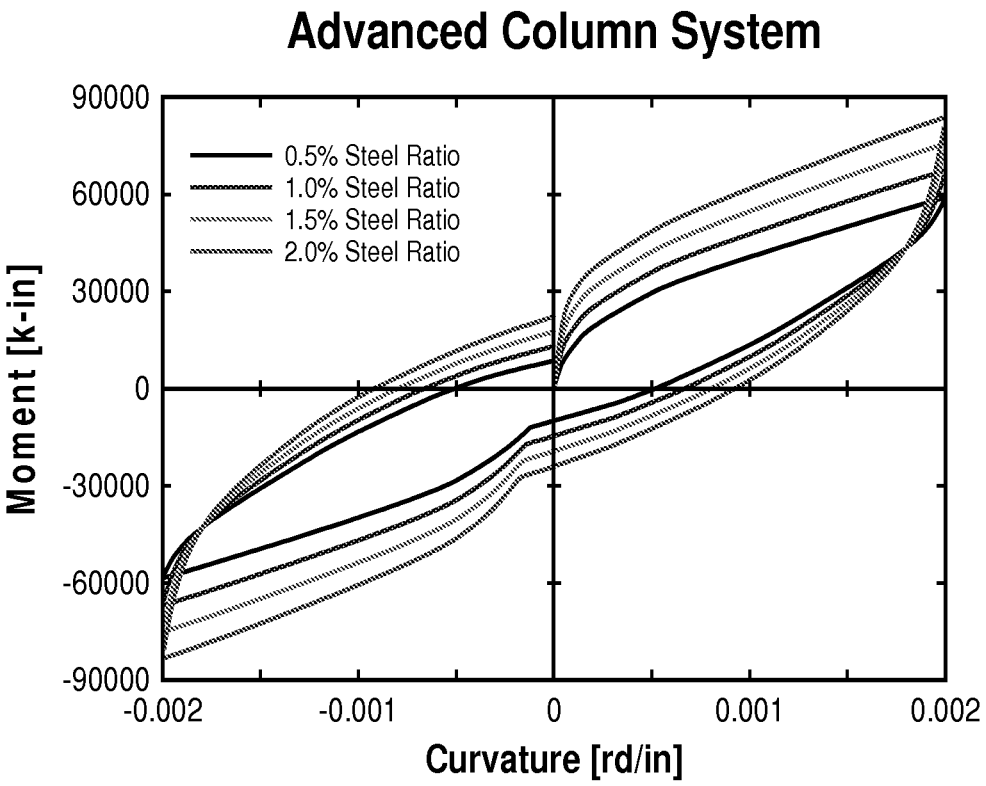
FIG. 3 displays moment curvature analyses results for 0.5%, 1.0%, 1.5%, and 2.0% mild steel fiber ratios.
Figure 4:
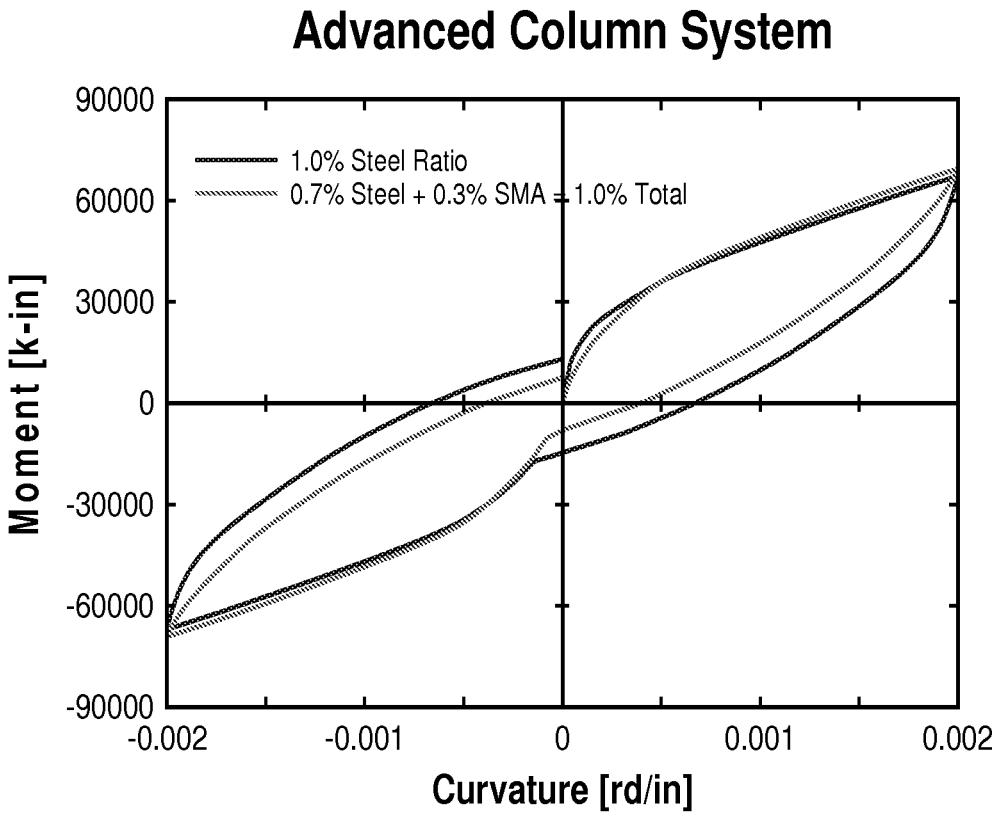
FIG. 4 shows a comparison of 1% mild steel fiber reinforcement versus a 1% combination of mild steel fiber reinforcement and SMA.
Figure 5:
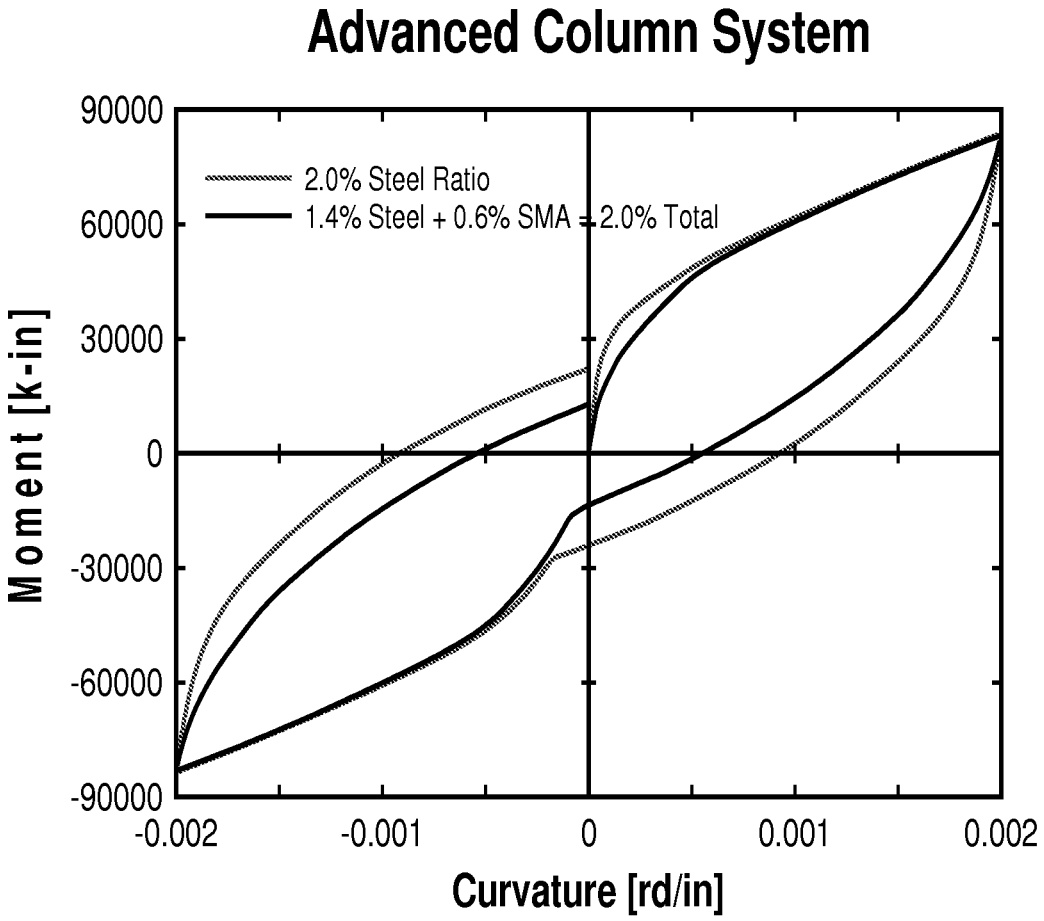
FIG. 5 shows a comparison of 2% mild steel fiber reinforcement versus a 2% combination of mild steel fiber reinforcement and SMA.

As further depicted in FIGS. 3-5, cyclic moment-curvature analyses were run for a 48" diameter column utilizing the advanced reinforcement system/assembly 10 using OpenSees. A parametric study was conducted by adjusting the metallic fiber content of the reinforcing FRP shell 14. The first set of analyses was conducted using mild steel fibers only in shell 14. The mild steel was assumed to have a yield strength, $F_y$, of 36 ksi, an ultimate strength, $F_u$ of 50 ksi, and ultimate strain, $\epsilon_u$, of 0.015. Moment-curvature analyses were then conducted for steel fiber reinforcing ratios of 0.5%, 1.0%, 1.5%, and 2.0%. The metallic fiber ratio, $\rho_s$, is calculated using Eq. 1, and the results can be seen in FIG. 3.

$$\rho_s = \frac{A_s}{A_g} \qquad \text{Eq. 1}$$

Where $A_s$ is the total cross-sectional area of the metallic fibers, and $A_g$ is the gross cross-sectional area of the column.

An additional set of moment curvature analyses were conducted using the same metallic fiber ratios but with 30% of the metallic fibers in shell 14 being shape memory alloy (SMA) and 70% of the metallic fibers in shell 14 being mild steel. FIGS. 4 and 5 display comparisons of moment curvature when using 1% and 2% of mild steel only in shell 14 versus a combination of mild steel and SMA fibers in shell 14.

The examples depicted in FIGS. 3-5 indicate that one can use the system and methods disclosed herein to adjust the fiber content in shell 14 to achieve different strengths and different energy dissipation capacities in a designed and fabricated structural column assembly 10. In certain embodiments, the greater the metallic fiber content of a column 10, the larger the area included by the curves depicted in the figures, indicating a larger capacity of the column 10 for energy dissipation.

Although the fiber matrix disclosed herein provides higher seismic and blast resistance to reinforced concrete columns, a detailed finite element simulation of the advanced reinforcement system can be used to further optimize the fiber matrix of the reinforcing shell 14 for improved reinforcement solutions. A calibrated finite element model can be used to further improve the concurrent shear resistance, confining action, and longitudinal resistance of the advanced reinforcing system/assembly 10.

While exemplary assemblies 10 have performed very well under imposed seismic and blast loading, an improved design for other assemblies 10 can be obtained from the finite element model and associated experimentation. As noted, large scale specimens utilizing exemplary assemblies 10 can be subjected to seismic, blast, and/or fire tests to confirm the multi-hazard resilience of the advanced reinforcement systems/assemblies 10 disclosed herein.

Another advantage of the columns/systems 10 disclosed herein is to minimize traffic disruptions during bridge rehabilitation and repairs through the use of pre-fabricated bridge elements/structures (e.g., assemblies 10) in accordance with the methods and structures 10 disclosed herein.

The present disclosure provides for a method and system for the design of innovative column systems/assemblies 10 to meet the specifications and demands of particular uses, industries, applications, bridges, highways, buildings and/or other structures.

In exemplary embodiments, the systems and methods disclosed herein have the following objects, not all of which may be present in any one particular application or structure: elimination of the use of steel reinforcing bars; capability to pre-design and pre-fabricate components; facilitate construction with minimal or no requirement for scaffolding; provide self-curing structural components; to provide structural columns 10 that are high performing under conditions of seismic events/forces, blasts of whatever origin, fire and other high temperature exposure, and collisions with moving objects and moving vehicles on land, in water, or in the air.

The present disclosure will be further described with respect to the following examples; however, the scope of the disclosure is not limited thereby. The following examples illustrate improved structural column assemblies and related fabrication/use methods.

Example 1: Development of Multi-Hazard Resilient Bridge Column System

In general, today's bridge construction industry demands the advent of alternative cost-effective column systems with prolonged service life that enable accelerated construction, and at the same time, offer superb multi-hazard resilience. Such sub-structure systems can enable bridges to support vehicular traffic even after exposure to extreme events such as, for example, earthquake, explosion, extreme fire, severe fire exposure, storm surge causing lateral load and uplift in bridge columns, vehicle collision, etc.

To this end, a novel bridge column system made up of a tabular composite shell, filled with concrete (e.g., un-reinforced concrete) is provided by the present disclosure. In exemplary embodiments, the composite tube is made up of metallic and non-metallic fibers to enhance the durability and present an improved multi-hazard resilience compared to the conventional reinforced concrete (RC) column system.

A two-phase study is proposed by the present disclosure to develop and optimize this column system, and propose a design guideline that can be implemented by bridge designers. This can be accomplished through optimization of the fiber lay-up and the volumetric ratio of the metallic fibers in the shell. In certain embodiments, integration of mild steel and super-elastic alloy fibers with non-metallic fibers (e.g., carbon or glass), can improve the blast and seismic resilience of bridge columns and ensure the un-interrupted service of a bridge after an extreme event. Heat resistant resins and/or a fire protection coating can be applied during the manufacturing of the tube to improve the fire resistance of the column. These modifications yield a product that can be utilized to construct next-generation bridges that are resilient to multi-hazard scenarios, and their service lives can span centuries. In addition, the proposed column system of the present disclosure simplifies the construction of a bridge by substantially eliminating the conventional concrete reinforcement, form work, and/or heavy scaffolding. The present disclosure proposes that this study can be conducted in two complementing phases as described herein.

Phase I: Optimization of the Composite Tube Using Analytical Models

At the end of this phase, an optimized structural composition can be developed for the exterior shell for an improved seismic and blast performance.

A detailed finite element (FE) simulation of the column system can be performed. In exemplary embodiments, the FE model can first be validated using the relevant data from shaking table experiments and blast tests on the concrete filled FRP tube (CFFT) columns The model can incorporate fiber-matrix composite elements for the exterior shell, and damage plasticity based solid elements for the concrete core. The interaction of the core and the shell can be modeled using proper contact properties. The calibrated model can be used to optimize/improve the fiber lay-up and fiber composition for an improved shear resistance, confinement, longitudinal resistance, and energy dissipation capacity. An extensive parametric study can help understand the design parameters of the column including, without limitation: 1) the influence of inner smoothness of the tube on the overall performance of the composite system, 2) the benefits of adding mild steel and super-elastic alloy fibers/strips in conjunction with non-metallic fibers, 3) the possibility of using a hollow core column to reduce the weight of the column with the goal of pre-fabricating columns offsite, and 4) the optimum embedded length of the tube in the foundation.

Phase II: Perform Earthquake, Blast and Fire Experiments on the Column Models

Multiple large scale column models can be constructed and subjected to a series of simulated earthquake, blast and extreme fire tests to verify the design of the composite shell. At the end of the Phase-II, a design guideline can be developed that includes provisions and requirements for the design and fabrication of the new column system for a certain set of demand parameters.

The knowledge acquired in Phase-I can be used to design and manufacture multiple large-scale column specimens based on the some of the most favorable shell composition designs. One can then fabricate the composite shell using filament winding and applying the fire proof coat to construct the composite tubes. The tubes can then be then filled with concrete. One of each column design can be subjected to simulated earthquake shaking using a bi-axial shaking table. Two of each column design can be subjected to two different intensities of blasts to investigate the performance of the columns under impulsive loads and their resistance to breaching and local damage. Two other columns can be sent to a fire testing facility and subjected to a long duration of intense heat per ASTM standard.

The conclusion of these experiments can confirm the multi-hazard resilience of the new column systems of the present disclosure. The execution of the experiments can increase the likelihood of this column system being adopted by users (e.g., the departments of transportation (DOTs) and bridge construction industry).

Example 2: Multi-Hazard Resilient Bridge Columns for Accelerated Bridge Construction A traditional approach for multi-hazard resilient design of bridge systems is to provide extra strength for the bridge components, an important component of which is the bridge columns. This approach has proven to add to the complexity and cost of the construction of a bridge. Even though the added structural strength and the utilization of high quality construction material address some of the design requirements, this is not yet the best solution. The development of novel structural systems, beyond the conventional reinforced concrete systems, is desired for addressing multi-hazard resilience requirements without substantially adding to construction costs and complexities.

The development of next generation structural systems to resist distractive effects of such damaging events, and at the same time, simplifying the bridge construction by enabling pre-fabrication and accelerated construction is a challenging task that requires a focused research effort. The present disclosure provides a solution that utilizes the unique mechanical and chemical properties of advanced construction materials such as fiber reinforced polymers, heat resistant resins, fire deterrent material; as well as new construction techniques.

Past research performed for the present disclosure has demonstrated the excellent durability and seismic and blast resilience of concrete-filled glass fiber reinforced tube columns. To further improve the multi-hazard resilience of this column system and facilitate bridge construction, a novel bridge column system composed of a composite shell that is made up of optimized fibers and filled with concrete (e.g., un-reinforced concrete) is proposed by the present disclosure. Various fiber types and layups have been studied to enhance durability and present an improved multi-hazard resilience in comparison with the conventional reinforced concrete (RC) column system. The proposed column system of the present disclosure enables accelerated construction by substantially eliminating the costly and time consuming phases of reinforcement fabrication, scaffolding, formwork, and form removal in the construction of bridge columns. In exemplary embodiment, the proposed system simplifies the construction of bridge columns to a level that a prefabricated composite shell will be placed in the footing and filled with concrete from its top.

It is noted that AASHTO has just released a design guideline titled: "AASHTO LRFD Guide Specifications for Design of Concrete-Filled FRP Tubes, 1st Edition". It is believed that this guideline will help expedite the adoption of the concrete filled FRP tube (CFFT) as a load carrying member in bridge designs.

A two part analytical and experimental study is proposed by the present disclosure to optimize the proposed bridge column system and develop a set of fabrication guidelines for the exterior tube, as well as design guidelines that can be used by the bridge designer. In exemplary embodiments, this can be accomplished through optimization of the fiber lay-up, as well as the material properties of the chosen fibers and resins. Heat resistant resins and/or a fire protection coating can advantageously be applied during the manufacturing of the shell to improve the fire resistance of the column. Integration of optimized fiber content and orientation and the addition of fire protection measures can significantly improve the blast, seismic, fire and impact resilience of this bridge column system, thereby ensuring an un-interrupted service of a bridge after an extreme event. The proposed system can be utilized in the construction of next-generation bridges that are resilient to multi-hazard scenarios and their service lives can span centuries, while radically simplifying the construction of bridges.

Phase I: Developing a Refined Finite Element Model of the Composite Column System In exemplary embodiments, a detailed finite element (FE) simulation of the proposed column system can be performed using the LS DYNA finite element package. The FE models will be first validated using the data from shaking table experiments and blast tests previously conducted on the concrete filled FRP tube (CFFT) columns. The model can incorporate fiber-matrix composite elements for the exterior shell and plasticity based solid elements for the concrete core. The interaction of the core and the shell can be modeled using representative contact properties. The calibrated column model can be incorporated in a model of the complete bridge systems to account for the system effects on the response of the column. The models can be subjected to air blast effects, recorded seismic motions, and a simulated truck collision to optimize the fiber lay-up and composition for improved shear resistance, concrete confinement, longitudinal resistance, and energy dissipation capacity. The project can include the following tasks:

Task 1—Conduct Literature Search:

A review of relevant specifications and technical literature can be conducted, and information can be collected and studied. The search can include the work on the concrete-filled composite tube columns, the shear transfer phenomena between the concrete core and exterior shell, and literature on the analytical modeling of composite elements using LS DYNA.

Task 2—Develop and Validate a FE Model for the Proposed Column System:

A detailed model of concrete filled composite tubes can be developed and validated using the available experimental data from shaking table tests and blast experiments addressed under Task 1.

Task 3—Select Prototype Bridges:

Approximately five prototype highway bridge structures can be selected. These prototype bridge structures can help in understand the influence of various geometric parameters on the system level response of a bridge to different extreme events.

Task 4—Incorporate the Validated Column Models to Conduct Non-Linear Analyses on the Prototype Bridge Models:

The validated models of Task 2 can be incorporated in the prototype bridge systems selected in Task 3. The bridge system models will then be subjected to a suite of recorded seismic ground accelerations, air blast events of different charges and standoff distances, equivalent lateral and uplift loadings due to storm surge, and truck collision effects. In exemplary embodiments, two versions of each bridge model can be studied, one incorporating conventional reinforced concrete columns, and the other with the exemplary columns of the present disclosure. The response of the exemplary columns of the present disclosure can be investigated as they are affected by the loads and bridge system parameters.

Task 5—Perform an Extensive Parametric Study on the Column Design:

Various parameters such as: 1) fiber layup, 2) fiber type, 3) fiber combinations, 4) fiber volume for different fiber types, 5) resin types, and 6) the effect of the end fixity of columns, among other parameters can be studied under different damaging scenarios.

Task 6—Quantify the Potential Economic Impact:

The cost benefits of incorporating the exemplary column systems of the present disclosure can be compared with the conventional reinforced column construction. The results can be extrapolated to the prototype bridges.

Task 7—Develop a Preliminary Design Guideline for the New Column System:

Based on the results obtained from the parametric studies, a preliminary design methodology can be proposed for the new column system of the present disclosure. The design guide can be developed following a format similar to that used in the AASHTO LRFD specifications.

Phase II: Performing Extreme Event Experiments on the Refined Design

In exemplary embodiments, the knowledge acquired in Phase I can be used to design and manufacture eight large-scale concrete filled FRP tube column specimens. The columns can be designed based on the two best performing systems achieved from the FE simulations.

The FRP shell can be fabricated using filament winding to manufacture the tubes. The tubes can then be filled with concrete either as a cast-in-place member or a pre-cast column One of each column design can be subjected to simulated earthquake shaking using a bi-axial shaking table. Two of each column design can be subjected to two different intensities of blasts with different stand-off distances to investigate the overall impulsive performance of the columns, as well as their resistance to breaching damage caused by nearby blast scenarios. The last two columns can be sent to a fire testing facility and subjected to a long duration of intense heat per ASTM standard.

The conclusion of these three sets of experiments can confirm the multi-hazard resilience of the developed systems of the present disclosure. This will increase the likelihood of this column system of the present disclosure being utilized by users (e.g., the departments of transportation (DOTs) and bridge construction industry). At the end, a comprehensive design guideline can be developed based on the outcomes of the research. This design guide can include the considerations and requirements for fabrication of the optimized FRP tube for a certain set of demands. The columns can be designed, constructed, and tested to develop a design guideline.

Task 1—Design Large Scale Columns Based on Findings from Phase I:

In exemplary embodiments, the two best column designs can be selected on the analytical performance observed in Phase I. Eight columns (four of each design) can be designed following the preliminary guidelines from Phase I, resulting in a total of eight large-scale concrete filled FRP tube column specimens.

Task 2—Locate Manufacturer to Produce the FRP Shell Reinforcement from Task 1:

The columns designed in Task 1 can be produced using the optimized fiber content and orientation developed in Phase I.

Task 3—Large Scale Shake Table Testing:

Two of the eight large scale columns (one of each design) can be constructed and then be subjected to a suite of recorded seismic ground accelerations of increasing intensity. The experimental performance of the FRP columns can be used to further validate the analytical models developed in Phase I.

Task 4—Large Scale Blast Testing:

Four columns (two of each design) can be tested for large scale blast testing. The columns can be subject to varying load intensities and standoff distances, and the blast performance of the columns can be compared with the analytical results of Phase I.

Task 5—Large Scale Fire Testing:

The remaining two column specimens can be subjected to extreme fire exposure at a participating fire testing facility.

The fire resistance of the newly designed FRP shell of the present disclosure can be monitored and used, and compared to the analytical work of Phase I.

Task 7—Revise Preliminary Design Guideline for the New Column System from Phase I:

Based on the results obtained from the experimental tests, the preliminary design methodology developed in Phase I can be revised as needed. The design guide can be developed following a format similar to that used in the AASHTO LRFD specifications.

Task 8—Prepare a Final Draft Report:

A final report that documents the entire research effort can then be prepared. Included can be a deployment plan that will discuss how the research results can be implemented, and design recommendations and several numerical examples.

Example 3: Multi-Hazard Resilient Bridge Column Systems for Surface Transportation Network The resilience of structural systems under extreme damaging events such as earthquakes, explosions, fires, storm surges, vehicle collisions, among some others, is traditionally attempted to be achieved through added strength and/or utilization of higher quality construction materials, which ultimately adds to the cost and complexity of bridge construction. Even though the added structural strength and the utilization of high quality construction material address some of today's design requirements, this is not yet the best solution. The development of novel structural systems, beyond the conventional reinforced concrete systems, is desired for addressing multi-hazard resilience requirements without substantially adding to construction costs and complexities.

In general, the structural safety and integrity of typical highway bridges is heavily reliant on the performance of their supporting columns. This makes them important components of multi-girder highway bridge structures. Current bridge construction industry demands the advent of alternative cost-effective bridge column systems with prolonged service life that enable accelerated bridge construction, and at the same time, offer improved multi-hazard resilience. Such sub-structure systems can enable bridges to support vehicular traffic even after exposure to extreme events.

Past research performed for the present disclosure has demonstrated the excellent durability and seismic and blast resilience of concrete-filled glass fiber reinforced tube columns.

In exemplary embodiments, the present disclosure provides a novel concrete-filled composite tube (CFFT) column for application in typical highway bridges. Such columns can be experimentally and analytically investigated. One improved feature of this column system is the substantial elimination of the internal reinforcement, without compromising its structural performance. Another difference of the system/assembly of the present disclosure from the current systems is the composition of the external shell. The composite shell of the present disclosure can be made of a combination of metallic and non-metallic fibers. For example, the content and layup of mild steel and shape memory alloy fibers/strips, as well as glass or carbon fibers can be optimized/improved to provide strength, energy dissipation capacity, and/or improve the re-centering characteristic of columns. The composition of the exterior shell, such as the content ratio of the metallic and non-metallic fibers and the fiber layup can be optimized/improved to achieve a multi-hazard resilient column system. Because of the inherent differences in the nature of damaging events such as blast, earthquake, storm surge and fire, an optimized/improved design is desired for the exterior shell to ensure the resilience of the bridge column under these events. The proposed column system can be subjected to simulated earthquake, blast and fire to investigate the performance of the column.

The proposed column system of the present disclosure enables accelerated construction by substantially eliminating the costly and time consuming tasks of reinforcement fabrication, scaffolding, formwork, and form removal in the construction of bridge columns. The proposed system simplifies the construction of bridge columns to a level that a pre-fabricated composite shell can be placed in the footing and filled with un-reinforced conventional strength concrete from its top.

Various design parameters such as the fiber layup, the type of fibers, and the content of each material within the shell can be analytically studied under different damaging scenarios. A detailed finite element (FE) simulation of the proposed column system can be performed using the LS-DYNA finite element package. The FE models can be first validated using the data from shaking table experiments and blast tests conducted on the concrete filled FRP tube (CFFT) columns. In exemplary embodiments, the knowledge acquired from analytical simulations can be used to design and manufacture fourteen large-scale specimens. These columns can be designed based on the two best performing systems achieved from the FE simulations.

Heat resistant resins and/or a specialized fire protection layer can advantageously be used within and/or applied on the shell (e.g., as the final step of the manufacturing of the shell). The tubes can then be filled with conventional unreinforced concrete either as cast-in-place members or precast columns. Two columns can be saved as benchmarks. Two of each column designs can be subjected to different intensities of earthquake shaking using a bi-axial shaking table. Two of each column designs can be subjected to two different intensities of blast with different stand-off distances to investigate the performance of the columns to impulse loading, as well as their resistance to breaching damage caused by nearby blasts. The last four columns can be subjected to a long duration of elevated temperature per ASTM E119 standard.

The damaged columns, as well as the benchmark columns, can be analyzed. A specialized test frame and a 943-kip MTS hydraulic actuator can be used to load the columns axially to their failure to measure the residual axial capacity of the damaged columns. The residual axial capacity of the columns can then be compared to those obtained from testing the benchmark columns to verify that the columns are able to carry large axial loads even after extreme damaging events.

The FE model can be used to investigate the performance of the columns under other damaging events such as truck collision and uplift due to a storm surge as part of a bridge system.

A comprehensive design guideline can be developed based on the outcomes of the research. This design guide can include the considerations and requirements for fabrication of the FRP shell for different structural demands. At the end, a design software can be developed to enable engineers to design this column system of the present disclosure.

The conclusion of these sets of experiments can confirm the multi-hazard resilience of the developed systems of the present disclosure. This can increase the likelihood of this column system of the present disclosure being utilized by users (e.g., the departments of transportation (DOTs) and bridge construction industry). The columns can be designed, constructed, and tested to develop a design guideline.

Whereas the disclosure has been described principally in connection with structural column assemblies, such description has been utilized for purposes of disclosure and is not intended as limiting the disclosure. To the contrary, it is recognized that the disclosed systems, methods, techniques and assemblies are capable of use with other assemblies/materials.

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A structural column assembly comprising:

a concrete core having an outer surface and defining a central axis, the concrete core containing no metallic reinforcing material; and a reinforced polymer shell that includes a polymeric material, non-metallic fibers and metallic fibers or strips, the reinforced polymer shell positioned around the outer surface of the concrete core;

wherein the metallic fibers or strips are substantially continuous; and wherein the metallic fibers or strips are oriented relative to the central axis of the concrete core by at least one of (i) winding the metallic fibers or strips within the reinforced polymer shell, (ii) winding the metallic fibers or strips on a surface of the reinforced polymer shell, (iii) coiling the metallic fibers or strips within the reinforced polymer shell, (iv) coiling the metallic fibers or strips on a surface of the reinforced polymer shell; (v) positioning a mesh of the metallic fibers or strips within the reinforced polymer shell, and (vi) positioning a mesh of the metallic fibers or strips on a surface of the reinforced polymer shell.

2. The assembly of claim 1, wherein the reinforced polymer shell is substantially circular.

3. The assembly of claim 1, wherein the polymeric material includes heat resistant resin.

4. The assembly of claim 1, wherein the non-metallic fibers are selected from the group consisting of glass, carbon, aramid, aromatic polyamide, and para-aramid fibers, and combinations thereof.

5. The assembly of claim 1, wherein the metallic fibers or strips are selected from the group consisting of mild steel, high strength steel, super-elastic metallic alloy, and shape memory metallic alloy fibers or strips, and combinations thereof.

6. The assembly of claim 1, wherein the non-metallic fibers and the metallic fibers or strips are embedded in the polymeric material.

7. The assembly of claim, wherein the reinforced polymer shell includes an outer surface; and further comprising a layer of fire protective material positioned around the outer surface of the reinforced polymer shell.

8. The assembly of claim 1, wherein the orientation of the non-metallic fibers is selected independently from the orientation of the metallic fibers or strips.

9. The assembly of claim 1, wherein two or more reinforcements of the non-metallic fibers and metallic fibers or strips are wound within the reinforced polymer shell or are wound on the surface of the reinforced polymer shell.

10. The assembly of claim 1, wherein two or more reinforcements of the non-metallic fibers and metallic fibers or strips are coiled within the reinforced polymer shell or are coiled on the surface of the reinforced polymer shell.

11. The assembly of claim 1, wherein two or more reinforcements of the non-metallic fibers and metallic fibers or strips are oriented in a mesh pattern within the reinforced polymer shell or are oriented in a mesh pattern on the surface of the reinforced polymer shell.

12. The assembly of claim 1, wherein one or more reinforcement of the non-metallic fibers are wound within the reinforced polymer shell or are wound on the surface of the reinforced polymer shell; and wherein one or more reinforcement of the metallic fibers or strips are oriented in a mesh pattern within the reinforced polymer shell or are oriented in a mesh pattern on the surface of the reinforced polymer shell.

13. The assembly of claim 1, wherein the non-metallic fibers are substantially continuous.

14. A structural column assembly comprising:

a concrete core having an outer surface, the concrete core containing no metallic reinforcing material;

a reinforced polymer shell having an outer surface, the reinforced polymer shell including a polymeric material, non-metallic fibers and metallic fibers or strips, the reinforced polymer shell positioned around the outer surface of the concrete core; and a layer of fire protective material positioned around the outer surface of the reinforced polymer shell;

wherein the polymeric material of the reinforced polymer shell includes a resin;

wherein one or more non-metallic fibers and one or more metallic fibers or strips are embedded in the polymeric material of the reinforced polymer shell;

wherein one or more reinforcement of the non-metallic fibers are wound within the reinforced polymer shell or are wound on the surface of the reinforced polymer shell;

wherein one or more reinforcement of the metallic fibers or strips are oriented in a mesh pattern within the reinforced polymer shell or are oriented in a mesh pattern on the surface of the reinforced polymer shell; and wherein the metallic fibers or strips and the non-metallic fibers are substantially continuous.

15. The assembly of claim 14, wherein the reinforced polymer shell is substantially circular.

* * * * *